US008648765B2

(12) United States Patent
Jeng

(10) Patent No.: US 8,648,765 B2
(45) Date of Patent: Feb. 11, 2014

(54) COMPACT SIZE ANTENNA OPERATING IN LTE FREQUENCY BANDS

(75) Inventor: Chang-Yueh Jeng, Taipei Hsien (TW)

(73) Assignee: Acer Incorporated, Taipei Hsien (TW)

( * ) Notice: Subject to any disclaimer, the term of this patent is extended or adjusted under 35 U.S.C. 154(b) by 363 days.

(21) Appl. No.: 13/150,779

(22) Filed: Jun. 1, 2011

(65) Prior Publication Data

US 2012/0218164 A1 Aug. 30, 2012

(30) Foreign Application Priority Data

Feb. 24, 2011 (TW) ..... 100106162 A

(51) Int. Cl.
*H01Q 1/48* (2006.01)

(52) U.S. Cl.
USPC ..... 343/848

(58) Field of Classification Search
USPC ..... 343/700 MS, 702, 848
See application file for complete search history.

(56) References Cited

U.S. PATENT DOCUMENTS 7,050,010 B2 * 5/2006 Wang et al. ..... 343/702
7,518,555 B2 * 4/2009 Heng et al. ..... 343/700 MS
2007/0103370 A1 5/2007 Hung et al.
2007/0171130 A1 7/2007 Chung et al.
2009/0058735 A1 3/2009 Hill et al.
2009/0109098 A1 4/2009 Hung et al.

FOREIGN PATENT DOCUMENTS

CN 201732860 2/2011

OTHER PUBLICATIONS

European Search Report dated Jun. 5, 2012.
Chinese language office action dated Dec. 2, 2013.
English language translation of abstract of CN 201732860 (published Feb. 2, 2011).

* cited by examiner

*Primary Examiner* — Seung Lee
(74) *Attorney, Agent, or Firm* — McClure, Qualey & Rodack, LLP

(57) ABSTRACT

A compact size antenna operating in LTE frequency bands includes a radiation element, a ground plane, a connecting piece, and a ground extension element. The radiation element at least includes a first radiation branch extending toward a first direction, wherein a connection end of the radiation element has a signal feeding point. The connecting piece is coupled to the ground plane. The ground extension element includes: a metal arm, coupled to the ground plane through the connecting piece; a first ground branch, coupled to the metal arm, and extending toward the first direction; a second ground branch coupled to the metal arm, and extending toward a second direction opposite to the first direction; and a third ground branch, coupled to the metal arm, coupled to the second ground branch, and extending toward the first direction.

18 Claims, 7 Drawing Sheets

COMPACT SIZE ANTENNA OPERATING IN LTE FREQUENCY BANDS

CROSS REFERENCE TO RELATED APPLICATIONS

This application claims priority of Taiwan Patent Application No. 100106162 filed on Feb. 24, 2011, the entirety of which is incorporated by reference herein.

BACKGROUND OF THE INVENTION

1. Field of the Invention

The disclosure generally relates to a compact size antenna, and more particularly, relates to a compact size antenna operating in LTE (Long Term Evolution) frequency bands.

2. Description of the Related Art

Nowadays, 2G or 3G communication system technology is applied in notebooks or tablet PCs. Telecommunication manufacturers all over the world have actively introduced LTE (Long Term Evolution) system. Therefore, it is required that in small spaces, an antenna of a communication device can operate in LTE and WWAN (Wireless Wide Area Network, WWAN) frequency bands. In prior art, a monopole antenna comprising two radiation branches and a PIFA (Planar Inverted F Antenna, PIFA) antenna can merely cover five WWAN system frequency bands, and do not cover LTE system frequency bands of 12, 13, 14, 17 (698 MHz-798 MHz) and 7, 38, 40 (2300-2690 MHz).

Thus, a compact size antenna operating in LTE frequency bands is required.

BRIEF SUMMARY OF THE INVENTION

In one exemplary embodiment, the disclosure is directed to a compact size antenna operating in LTE frequency bands, comprising: a radiation element, at least comprising a first radiation branch, wherein the first radiation branch extends toward a first direction, and a connection end of the radiation element comprises a signal feeding point; a ground plane; a connecting piece, coupled to the ground plane; and a ground extension element, comprising: a metal arm, coupled to the ground plane through the connecting piece; a first ground branch, coupled to the metal arm, and extending toward the first direction; a second ground branch, coupled to the metal arm, and extending toward a second direction opposite to the first direction; and a third ground branch, coupled to the metal arm, coupled to the second ground branch, and extending toward the first direction.

In another exemplary embodiment, the disclosure is directed to a compact size antenna, comprising: a radiation element, disposed on a first plane, and at least comprising a first radiation branch that extends toward a first direction, wherein a connection end of the radiation element comprises a signal feeding point; a ground plane; a connecting piece, coupled to the ground plane; and a ground extension element, disposed on a second plane perpendicular to the first plane, and comprising: a C-shaped element, coupled to the ground plane through the connecting piece; and a ground branch, coupled to the C-shaped element, and extending toward the first direction.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
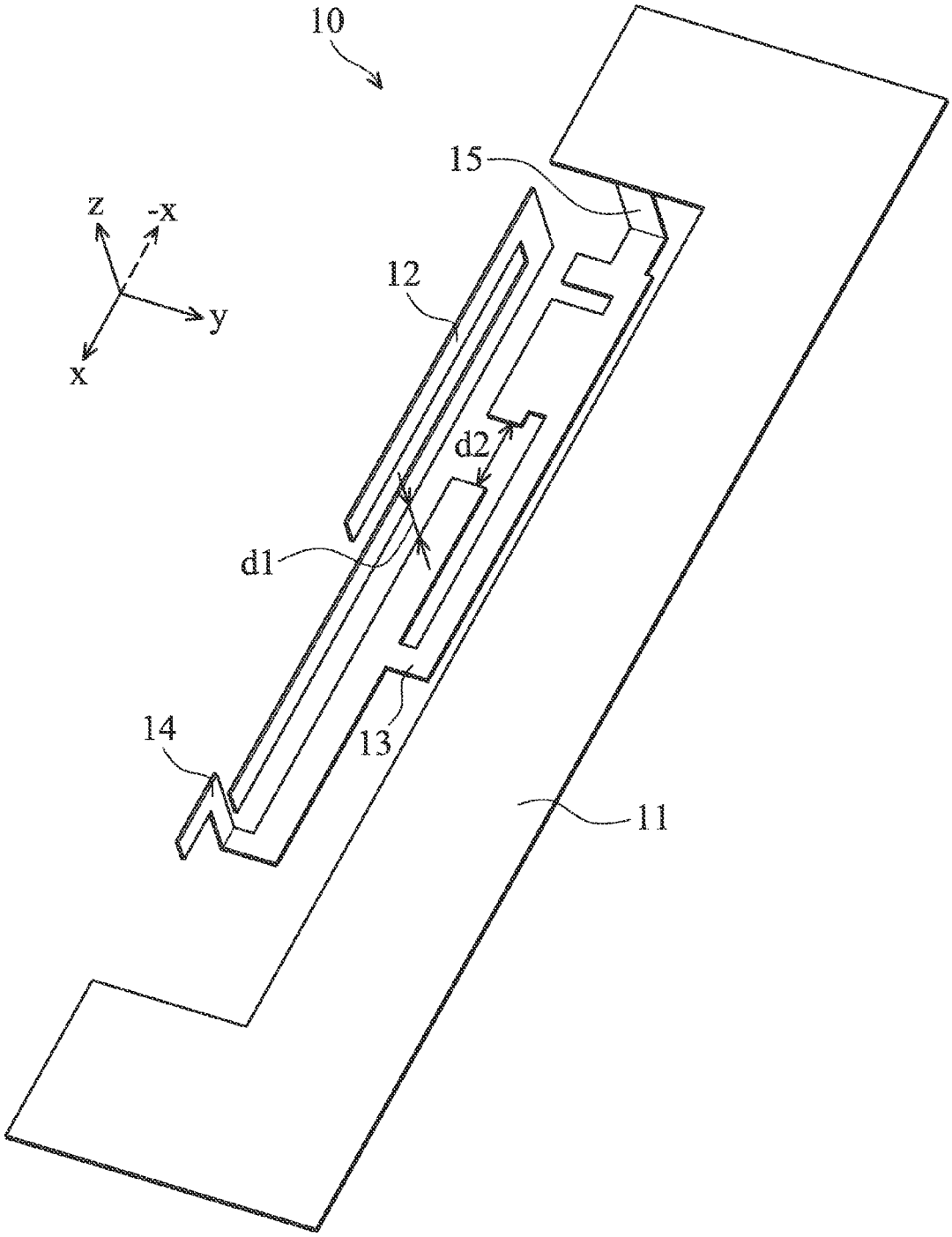
FIG. 1 is a pictorial drawing illustrating a compact size antenna according to an embodiment of the invention.

FIG. 1 is a pictorial drawing illustrating a compact size antenna 10 according to an embodiment of the invention. As shown in FIG. 1, the compact size antenna 10 comprises: a ground plane 11, a substrate (not shown), a radiation element 12, a ground extension element 13, an appended ground branch 14, and a connecting piece 15. The ground plane 11 may be a large area of metal plane. The substrate may be a glass fiber substrate attached to the bottom of the ground plane 11. In the embodiment, the radiation element 12 may be made of metal and may be disposed on an XZ-plane of a coordinate system, the ground extension element 13 may be made of metal and may be disposed on an XY-plane of the coordinate system, and the appended ground branch 14 may be made of metal and may be disposed on an XZ-plane of the coordinate system. It is noted that the embodiment is just utilized for illustration, and not limitation of the invention. The appended ground branch 14 may be coupled to the ground extension element 13, and may be of an L-shape. In some embodiments of the invention, the appended ground branch 14 may be eliminated or merely a part of the extension of the ground extension element 13. The connecting piece 15 may be made of metal, disposed on an YZ-plane of the coordinate system, and coupled to the ground plane 11 and ground extension element 13.

Figure 2A:
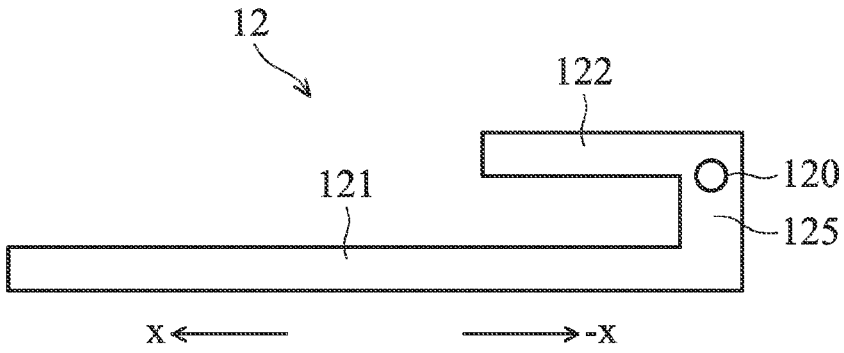
FIG. 2A is a plan-view drawing illustrating a radiation element according to an embodiment of the invention.

FIG. 2A is a plan-view drawing illustrating the radiation element 12 according to an embodiment of the invention. As shown in FIG. 2A, the radiation element 12 may comprise radiation branches 121, 122 that are coupled to each other. The radiation branches 121, 122 both extend toward a positive X-axis of the coordinate system. A signal feeding point 120 of the compact size antenna 10 is disposed on the connection of radiation branches 121, 122, i.e., a connection end 125 of the radiation element 12, wherein energy or a signal can be fed into the compact size antenna 10 via the signal feeding point 120. A length of the radiation branch 121 corresponding to a lower frequency is greater than a length of the radiation branch 122 corresponding to a higher frequency. Furthermore, as shown in FIGS. 1 and 2A, a distance between the radiation branch 121 and the ground extension element 13 is smaller than a predetermined distance d1. In an embodiment of the invention, the predetermined distance d1 is approximately equal to 2.3 mm, and the predetermined distance d1 is approximately equal to a 0.05 wavelength, with the condition that a central frequency is 2300 MHz and a dielectric coefficient is 2.5. It is noted that the sizes of the elements in the above embodiment are not limited. A person of ordinary skill can adjust the sizes of the elements according to the central frequency and the dielectric coefficient.

Figure 2B:
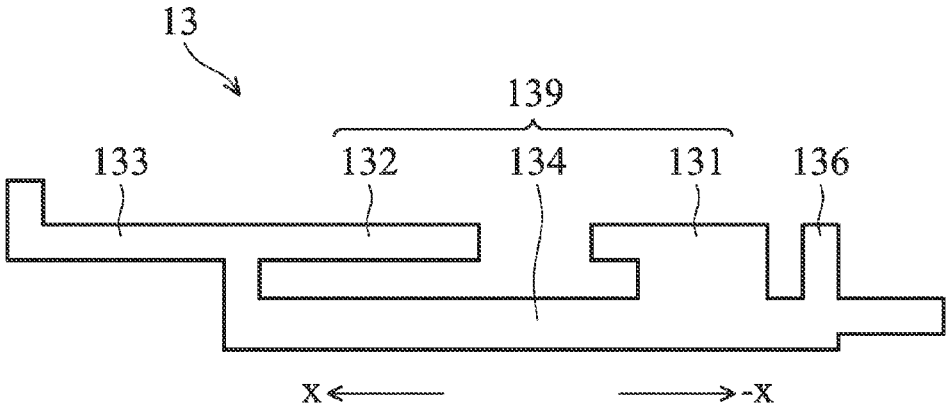
FIG. 2B is a plan-view drawing illustrating a ground extension element according to an embodiment of the invention.

FIG. 2B is a plan-view drawing illustrating the ground extension element 13 according to an embodiment of the invention. As shown in FIG. 2B, the ground extension element 13 may comprise ground branches 131, 132, 133, a metal arm 134, and a matching element 136. The ground branches 131, 132 and the metal arm 134 constitute a C-shaped element 139. The metal arm 134 may coupled to the connecting piece 15. The ground branches 131, 133 are both coupled to the metal arm 134, and both extend toward a positive X-axis of the coordinate system. The ground branch 132 is coupled to the metal arm 134, and extends toward negative X-axis of the coordinate system. In addition, the ground branch 133 is coupled to the ground branch 132. The matching element 136 is coupled to the metal arm 134. If the length of the matching element 136 changes, impedance matching of the compact size antenna 10 will be adjusted. As shown in FIG. 1, there is a gap between the ground branches 131, 132, wherein the gap is smaller than a predetermined distance d2. In an embodiment of the invention, the predetermined distance d2 is approximately equal to 6.1 mm, and the predetermined distance d2 is approximately equal to a 0.2 wavelength on the condition that a central frequency is 2300 MHz and a dielectric coefficient is 2.5. The appended ground branch 14 may be coupled to a free end of the ground branch 133. It is noted that the sizes of the elements in the above embodiment is not limited. A person of ordinary skill can adjust the sizes of the elements according to the central frequency and the dielectric coefficient.

Figure 3:
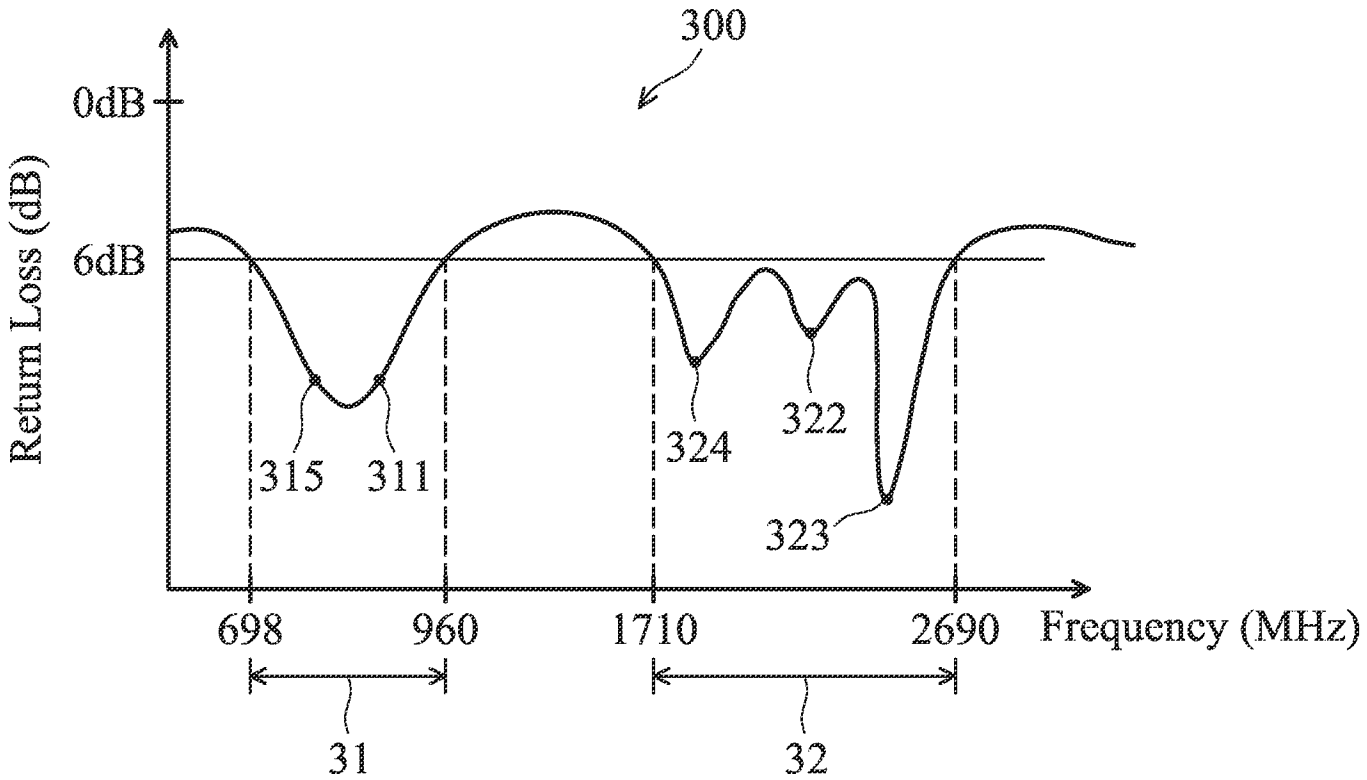
FIG. 3 is a diagram illustrating return loss of the compact size antenna according to an embodiment of the invention.

FIG. 3 is a diagram 300 illustrating return loss of the compact size antenna 10 according to an embodiment of the invention. FIG. 3 is utilized for illustrating measured return loss (unit: dB) over frequency (unit: MHz) on the condition that energy or a signal is fed into the compact size antenna 10 via the signal feeding point 120. As shown in FIG. 3, the compact size antenna 10 comprises operating frequency bands 31, 32 according to the criterion set as 6 dB. In an embodiment of the invention, the operating frequency band 31 covers from about 698 MHz to 960 MHz, covering the LTE700/GSM850/900, and the operating frequency band 32 covers from about 1710 MHz to 2690 MHz, covering the GSM1800/PCS1900/WCDMA Band1/LTE2700. Therefore, the compact size antenna 10 can meet frequency bands of 2G/3G/LTE communication systems. The compact size antenna 10 can cover LTE frequency bands except for "band 11" and "band 21" of LTE communication systems.

In an aspect of antenna theory, the radiation branch 121 may be excited to form a frequency point 311 in the operating frequency band 31. The connecting piece 15, the ground branch 132, and the metal arm 134 may be excited to form a frequency point 322 in the operating frequency band 32. The connecting piece 15, the ground branch 131, and a portion of the metal arm 134 may be excited to form a frequency point 323 in the operating frequency band 32. The radiation branch 122 may be excited to form a frequency point 324 in the operating frequency band 32. The appended ground branch 14, the connecting piece 15, the ground branch 133, and the metal arm 134 may be excited to form a frequency point 315 in the operating frequency band 31. The above frequency points can be ordered from low to high as follows, the frequency points 315, 311, 324, 322 and 323.

In some embodiments of the invention, the sizes of the elements in the compact size antenna 10 are as follows: the length of the ground plane 11 is approximately equal to 246 mm; the width of the ground plane 11 is approximately equal to 150 mm; the thickness of the substrate is approximately equal to 1 mm; the length of the radiation branch 121 is approximately equal to 53 mm; the width of the radiation branch 121 is approximately equal to 2 mm; the length of the radiation branch 122 is approximately equal to 33 mm; the width of the radiation branch 122 is approximately equal to 2 mm; the total length of the appended ground branch 14, the connecting piece 15, the ground branch 133 and the metal arm 134 is approximately equal to 91.9 mm; the total length of the connecting piece 15, the ground branch 132 and the metal arm 134 is approximately equal to 70.6 mm; and the total length of the connecting piece 15, the ground branch 131, the portion of the metal arm 14 is approximately equal to 17.4 mm. It is noted that the sizes of the elements in the above embodiment are not limited. A person of ordinary skill can adjust the sizes of the elements according to the central frequency and the dielectric coefficient.

Figure 4:
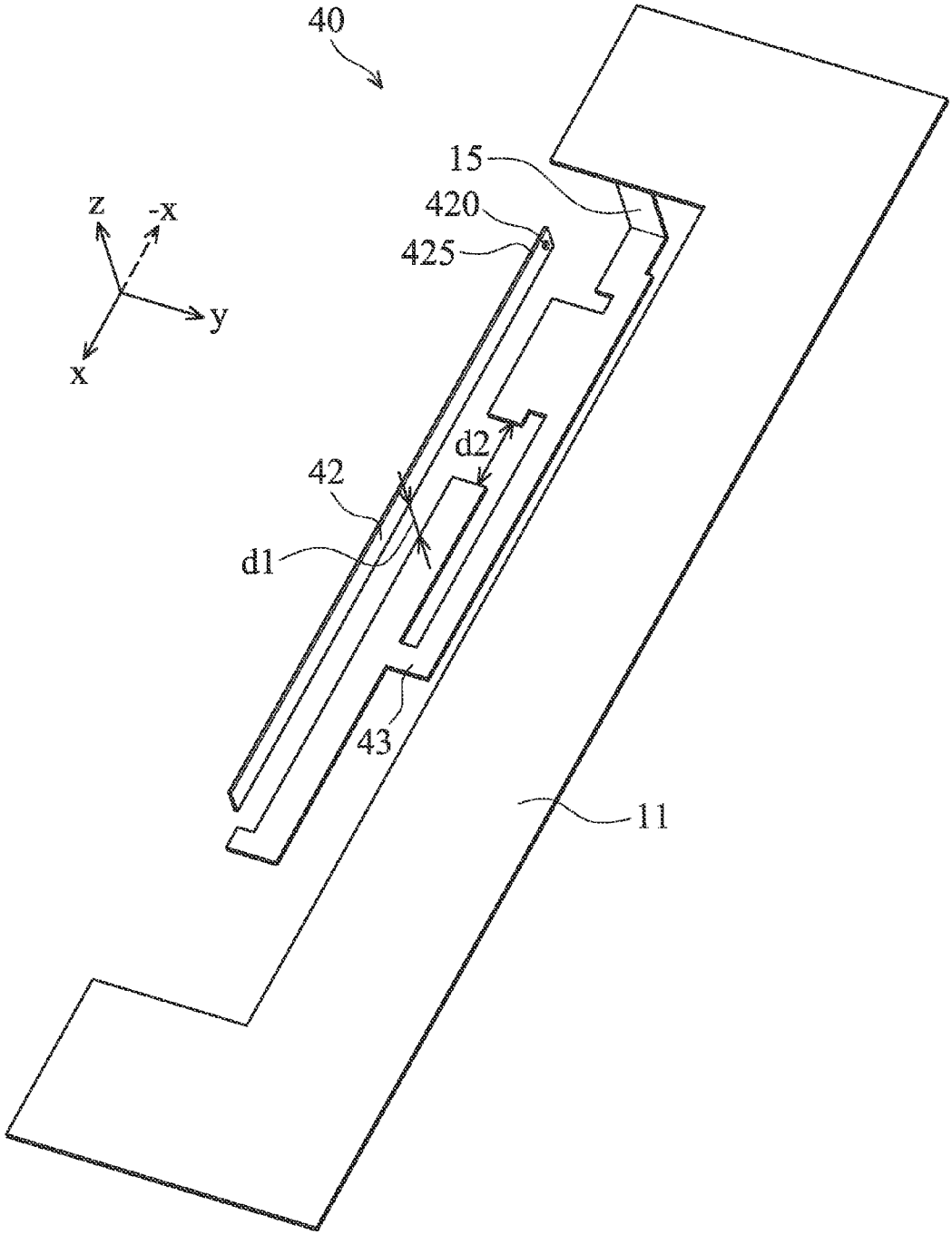
FIG. 4 is a pictorial drawing illustrating a compact size antenna according to another embodiment of the invention.

FIG. 4 is a pictorial drawing illustrating a compact size antenna 40 according to another embodiment of the invention. The compact size antenna 40 of FIG. 4 is similar to the compact size antenna 10 of FIG. 1, but the differences are as follows: (1) a radiation element 42 of the compact size antenna 40 only includes the radiation branch 121, and a signal feeding point 420 is disposed on a connection end 425 of the radiation element 42; (2) a ground extension element 43 of the compact size antenna 40 does not include the matching element 136; and (3) the compact size antenna 40 does not include the appended ground branch 14.

Figure 5:
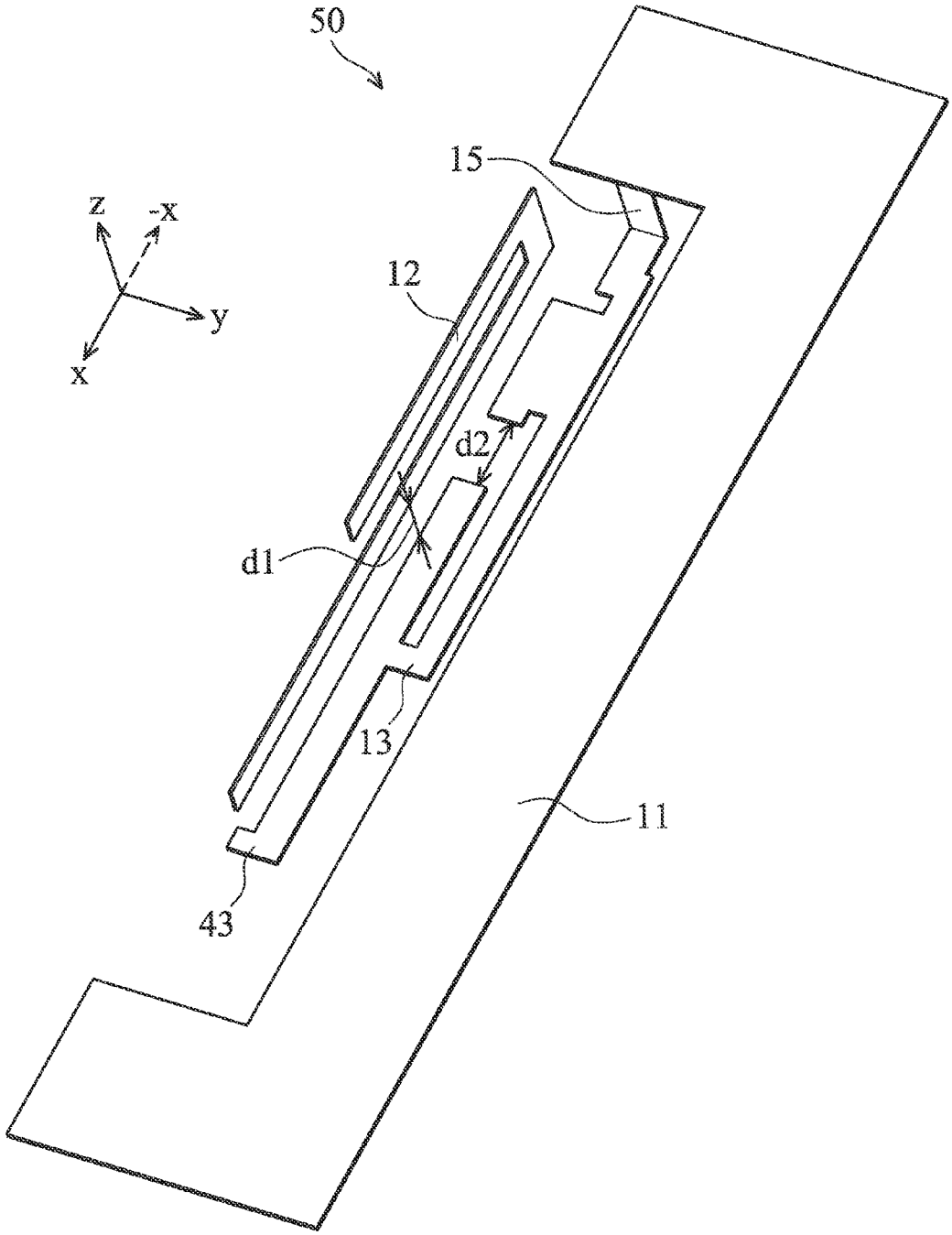
FIG. 5 is a pictorial drawing illustrating a compact size antenna according to another embodiment of the invention.

FIG. 5 is a pictorial drawing illustrating a compact size antenna 50 according to another embodiment of the invention. The compact size antenna 50 of FIG. 5 is similar to the compact size antenna 10 of FIG. 1, but the differences are as follows: (1) a ground extension element 43 of the compact size antenna 50 does not include the matching element 136; and (3) the compact size antenna 50 does not include the appended ground branch 14.

Figure 6:
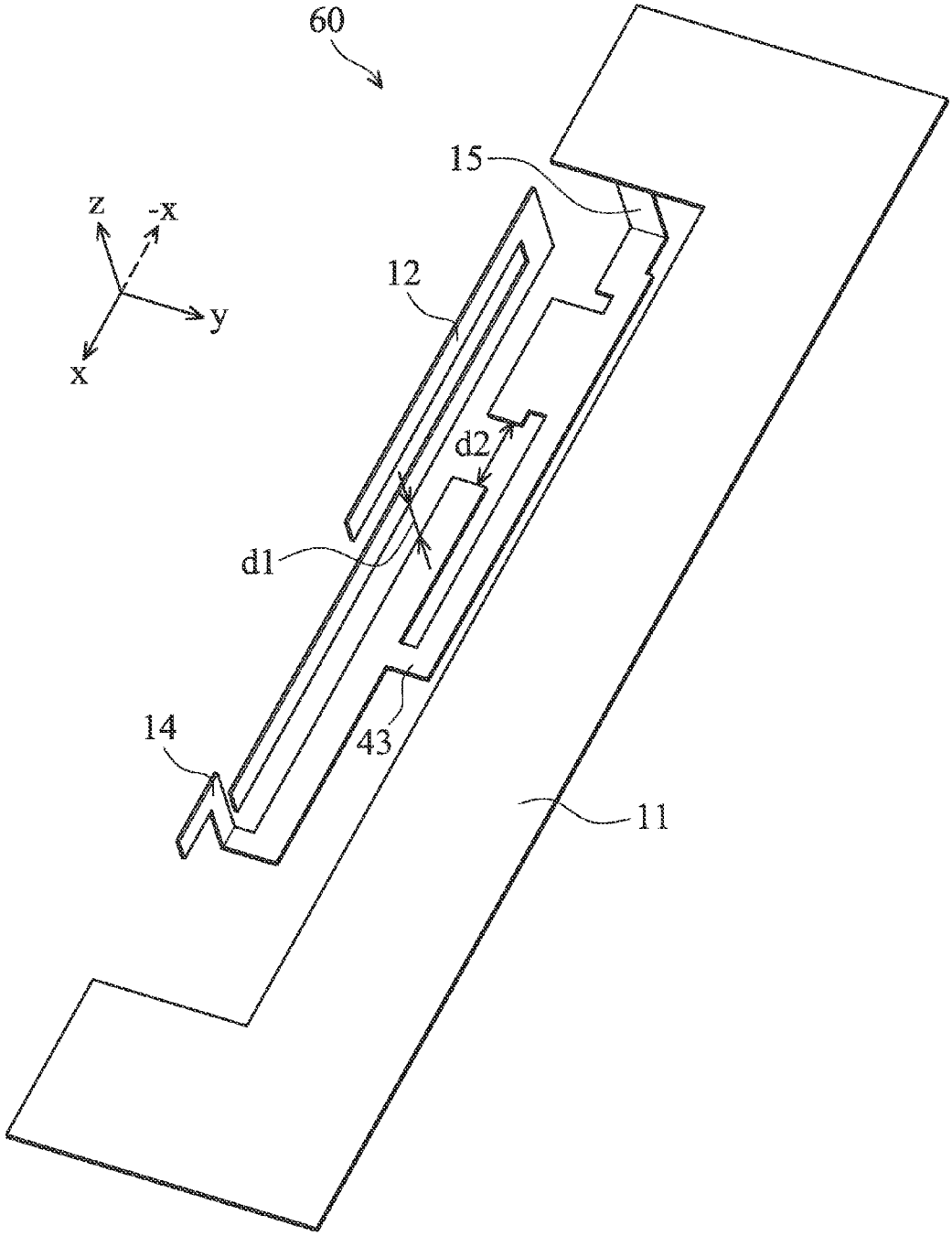
FIG. 6 is a pictorial drawing illustrating a compact size antenna according to another embodiment of the invention.

FIG. 6 is a pictorial drawing illustrating a compact size antenna 60 according to another embodiment of the invention. The compact size antenna 60 of FIG. 6 is similar to the compact size antenna 10 of FIG. 1, but the differences are as follows: the compact size antenna 60 does not include the appended ground branch 14.

Figure 7:
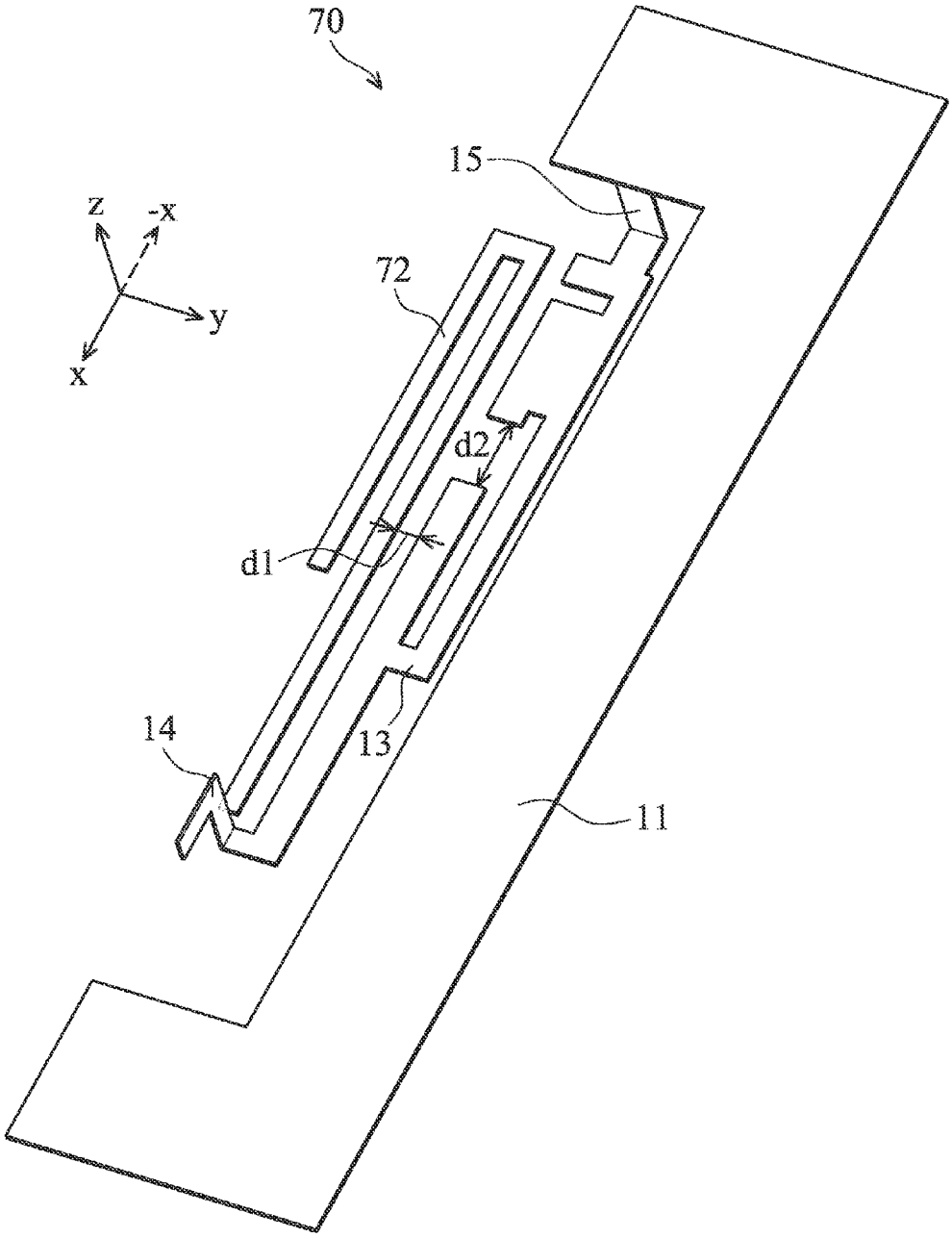
FIG. 7 is a pictorial drawing illustrating a compact size antenna according to another embodiment of the invention.

FIG. 7 is a pictorial drawing illustrating a compact size antenna 70 according to another embodiment of the invention. The compact size antenna 70 of FIG. 7 is similar to the compact size antenna 10 of FIG. 1, but the differences are as follows: a radiation element 72 and the ground extension element 43 of the compact size antenna 70 are disposed on the same plane, i.e., XY-plane of the coordinate system.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A compact size antenna operating in LTE frequency bands, comprising:

a radiation element, at least comprising a first radiation branch, wherein the first radiation branch extends toward a first direction, and a connection end of the radiation element comprises a signal feeding point;

a ground plane;

a connecting piece, coupled to the ground plane; and a ground extension element, comprising:

a metal arm, coupled to the ground plane through the connecting piece;

a first ground branch, coupled to the metal arm, and extending toward the first direction;

a second ground branch, coupled to the metal arm, and extending toward a second direction opposite to the first direction; and a third ground branch, coupled to the metal arm and the second ground branch, and extending toward the first direction;

wherein:

the first radiation branch is excited to form a first frequency point in a first operating frequency band;

the connecting piece, the metal arm, and the second ground branch are excited to form a second frequency point in a second operating frequency band; and the connecting piece, a portion of the metal arm, and the first ground branch are excited to form a third frequency point in the second operating frequency band.

2. The compact size antenna as claimed in claim 1, wherein the radiation element further comprises:

a second radiation branch, coupled to the connection end of the first radiation branch, extending toward the first direction, and excited to form a fourth frequency point in the second operating frequency band.

3. The compact size antenna as claimed in claim 1, wherein the first operating frequency band covers from about 698 MHz to 960 MHz, and the second operating frequency band covers from about 1710 MHz to 2690 MHz.

4. The compact size antenna as claimed in claim 1, wherein the ground extension element further comprises:

a matching element, coupled to the metal arm for adjusting impedance matching.

5. The compact size antenna as claimed in claim 1, wherein a distance between the first radiation branch and the ground extension element is smaller than a first predetermined distance, and the first predetermined distance is approximately equal to 2.3 mm.

6. The compact size antenna as claimed in claim 1, wherein a distance between the first ground branch and the second ground branch is smaller than a second predetermined distance, and the second predetermined distance is approximately equal to 6.1 mm.

7. A compact size antenna operating in LTE frequency bands, comprising:

a radiation element, at least comprising a first radiation branch, wherein the first radiation branch extends toward a first direction, and a connection end of the radiation element comprises a signal feeding point;

a ground plane;

a connecting piece, coupled to the ground plane;

a ground extension element, comprising:

a metal arm, coupled to the ground plane through the connecting piece;

a first ground branch, coupled to the metal arm, and extending toward the first direction;

a second ground branch, coupled to the metal arm, and extending toward a second direction opposite to the first direction; and a third ground branch, coupled to the metal arm and the second ground branch, and extending toward the first direction; and an appended ground branch, coupled to a free end of the third ground branch, wherein the appended ground branch, the third ground branch, the metal arm and the connecting piece are excited to form a fifth frequency point in the first operating frequency band.

8. The compact size antenna as claimed in claim 7, wherein:

the radiation element is disposed on a first plane;

the ground extension element and the appended ground branch are disposed on a second plane perpendicular to the first plane; and the appended ground branch is of an L-shaped.

9. The compact size antenna as claimed in claim 7, wherein:

the first radiation branch is excited to form a first frequency point in a first operating frequency band;

the connecting piece, the metal arm, and the second ground branch are excited to form a second frequency point in a second operating frequency band; and the connecting piece, a portion of the metal arm, and the first ground branch are excited to form a third frequency point in the second operating frequency band.

10. The compact size antenna as claimed in claim 9, wherein the radiation element further comprises:

a second radiation branch, coupled to the connection end of the first radiation branch, extending toward the first direction, and excited to form a fourth frequency point in the second operating frequency band.

11. The compact size antenna as claimed in claim 9, wherein the first operating frequency band covers from about 698 MHz to 960 MHz, and the second operating frequency band covers from about 1710 MHz to 2690 MHz.

12. The compact size antenna as claimed in claim 7, wherein the ground extension element further comprises:

a matching element, coupled to the metal arm for adjusting impedance matching.

13. The compact size antenna as claimed in claim 7, wherein a distance between the first radiation branch and the ground extension element is smaller than a first predetermined distance, and the first predetermined distance is approximately equal to 2.3 mm.

14. The compact size antenna as claimed in claim 7, wherein a distance between the first ground branch and the second ground branch is smaller than a second predetermined distance, and the second predetermined distance is approximately equal to 6.1 mm.

15. A compact size antenna operating in LTE frequency bands, comprising:

a radiation element, at least comprising a first radiation branch, wherein the first radiation branch extends toward a first direction, and a connection end of the radiation element comprises a signal feeding point;

a ground plane;

a connecting piece, coupled to the ground plane; and a ground extension element, comprising:

a metal arm, coupled to the ground plane through the connecting piece;

a first ground branch, coupled to the metal arm, and extending toward the first direction;

a second ground branch, coupled to the metal arm, and extending toward a second direction opposite to the first direction; and a third ground branch, coupled to the metal arm and the second ground branch, and extending toward the first direction;

wherein:

the radiation element is disposed on a first plane;

the ground extension element is disposed on a second plane perpendicular to the first plane; and the connecting piece is disposed on a third plane perpendicular to the first plane and the second plane.

16. The compact size antenna as claimed in claim 15, wherein:

the first radiation branch is excited to form a first frequency point in a first operating frequency band;

the connecting piece, the metal arm, and the second ground branch are excited to form a second frequency point in a second operating frequency band; and the connecting piece, a portion of the metal arm, and the first ground branch are excited to form a third frequency point in the second operating frequency band.

17. The compact size antenna as claimed in claim 16, wherein the radiation element further comprises:

a second radiation branch, coupled to the connection end of the first radiation branch, extending toward the first direction, and excited to form a fourth frequency point in the second operating frequency band.

18. The compact size antenna as claimed in claim 16, wherein the first operating frequency band covers from about 698 MHz to 960 MHz, and the second operating frequency band covers from about 1710 MHz to 2690 MHz.

* * * * *